US009476168B2

(12) United States Patent
Oetken et al.

(10) Patent No.: US 9,476,168 B2
(45) Date of Patent: Oct. 25, 2016

(54) ASPHALT PAVER TEMPERATURE ALERT SYSTEM FOR ASPHALT COMPACTOR OPERATOR

(71) Applicant: CATERPILLAR PAVING PRODUCTS INC., Minneapolis, MN (US)

(72) Inventors: Nicholas Alan Oetken, Brooklyn Park, MI (US); Ronald Utterodt, Lutten (DE)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 105 days.

(21) Appl. No.: 14/472,870

(22) Filed: Aug. 29, 2014

(65) Prior Publication Data

US 2016/0060819 A1 Mar. 3, 2016

(51) Int. Cl.

| | |
|---|---|
| ***E01C 23/14*** | (2006.01) |
| ***E01C 19/00*** | (2006.01) |
| ***E01C 19/23*** | (2006.01) |
| ***E01C 19/48*** | (2006.01) |
| ***E01C 19/42*** | (2006.01) |
| ***E01C 21/00*** | (2006.01) |

(52) U.S. Cl.

CPC ..... *E01C 19/002* (2013.01); *E01C 19/23* (2013.01); *E01C 19/42* (2013.01); *E01C 19/488* (2013.01); *E01C 21/00* (2013.01)

(58) Field of Classification Search

CPC ..... E01C 23/14

USPC ..... 404/84.1, 95

See application file for complete search history.

(56) References Cited

U.S. PATENT DOCUMENTS

| | | | | |
|---|---|---|---|---|
| 6,749,364 | B1 | 6/2004 | Baker et al. | |
| 8,099,218 | B2 | 1/2012 | Glee et al. | |
| 8,382,395 | B2 | 2/2013 | Glee et al. | |
| 2008/0260462 | A1 | 10/2008 | Ackermann | |
| 2009/0142133 | A1 | 6/2009 | Glee et al. | |
| 2009/0317186 | A1 | 12/2009 | Glee et al. | |
| 2013/0136539 | A1 | 5/2013 | Aardema | |
| 2013/0290062 | A1* | 10/2013 | Patel | G06Q 10/06313 705/7.23 |
| 2014/0086684 | A1* | 3/2014 | Sehr | G01D 21/02 404/84.05 |

FOREIGN PATENT DOCUMENTS

| | | |
|---|---|---|
| EP | 2 666 908 | 11/2013 |

* cited by examiner

*Primary Examiner* — Gary Hartmann

(74) *Attorney, Agent, or Firm* — Finnegan, Henderson, Farabow, Garrett & Dunner, LLP

(57) ABSTRACT

A system and method for controlling a paving operation includes applying asphalt to a surface using a screed mounted on a paving machine, scanning a surface of the asphalt as it is applied by the screed immediately behind the paving machine using a thermal scanner mounted on the paving machine, and transmitting a signal indicative of a scanned temperature of the asphalt from the paving machine. The signal is received at the compactor and is indicative of the scanned temperature of the asphalt. The signal is used to notify a compactor operator at the compactor.

19 Claims, 2 Drawing Sheets

ASPHALT PAVER TEMPERATURE ALERT SYSTEM FOR ASPHALT COMPACTOR OPERATOR

TECHNICAL FIELD

This disclosure relates generally to a temperature alert system and, more particularly, to an asphalt paver temperature alert system for an asphalt compactor operator.

BACKGROUND

Preparation of roadways, building sites, embankments, and other surfaces often requires compaction to produce desired material properties. Compactors are employed to compact various paving materials such as, for example, soil, gravel, and an asphalt material. The desired degree of material compaction can vary based on the type of material being compacted and/or conditions of the material such as, for example, soil moisture content and asphalt temperature. Compaction levels are important for maintaining stability of the paving material. When undercompacted, paving surfaces lack sufficient strength to support traffic loads and are not durable. When overcompacted, asphalt and other paving materials can be permanently deformed. During a compaction process, the degree of material compaction can be measured and evaluated for conformity with job specifications.

Typical paving machines include a tractor for providing mobility and power, a hopper containing a supply of a bituminous aggregated mixture or asphalt, and a screed that lays the asphalt paving material onto an area to be paved in a strip of uniform thickness. The tractor typically includes a combustion engine configured to power operations of the paving machine, and the engine may be any of a variety of known power plants that may include gas turbine engines, natural gas powered engines, diesel engines, and gasoline engines. The asphalt paving material is heated and is applied when it has a plastic consistency so that it may be easily applied in a layer of uniform thickness. In a repaving operation, the new asphalt material may be laid upon the old surface of the roadway. It has been found that the new asphalt material adheres to the old road surface much better when the old road surface is warm. Poor results are obtained when the new asphalt material is applied upon a cold roadway. Similarly, poor results are obtained when compaction of the new asphalt material is attempted with the asphalt material being at a temperature that falls outside of a preferred range of temperatures. For this reason, specific temperature conditions exist under which paving must occur to ensure pavement quality. This limits the length of the paving season and the productivity on days when paving crews must wait for the temperature to rise. Furthermore, information regarding the temperature of the asphalt material that has just been applied by the screed is information that may be important to an operator of a compactor following the paving machine.

A screed assembly typically includes a base portion and may include one or more extension portions, each of these portions having steel screed plates mounted to the screed portions in such a manner that the plates both smooth and compress the deposited paving material, leaving behind a mat of the desired thickness. The screed plates are typically heated to prevent the asphalt material from clinging to the steel plates. In modern screed assemblies, the screed plate heaters are commonly implemented in the form of resistive electrical heaters that can be optimally positioned on or near the screed plates. Screed plates may also be heated by gas or other combustible fuel heaters. It is important to maintain a proper screed plate temperature. If the screed plates are either too hot or too cold, a poor finish will be obtained in the resulting pavement mat. In a simple screed having only base screed portions, each of the base screed portions typically includes both a heater and a temperature sensor. In such a system, each of the base screed plates may be individually temperature controlled according to feedback received from the associated temperature sensor. A wider screed requires more heaters, and the heaters are generally arranged into independent heating zones. Electric power to the heaters is controlled by a screed power module (SPM). During the paving process it is important to monitor the real-time temperature of the asphalt in order to know whether the asphalt is within an optimum temperature range for compaction.

During operation of a paving screed, an undesirable situation arises when the temperature of the new asphalt just applied by the screed cools off too much before a compactor following behind the paving screed has completed compaction of the asphalt. As a result, there is a need to identify the temperature at the surface of the asphalt in real-time as it is applied by the screed and provide the temperature information to an operator of the compactor following behind the screed. Typically, compactor vehicles used with asphalt material mats include a vehicle body and a pair of drum members or "drums" rotatably mounted to the body. Such compactor vehicles generally function by rolling over sections of the formed material mat such that the drums compact the formed material mat with every pass made over a particular section of the formed material mat, the drums also functioning to mobilize the compactor vehicles. A vibratory mechanism may be mounted within each drum to increase the extent of formed material mat compaction made by each pass of the drums. These vibratory mechanisms are generally variable in frequency and amplitude, variations in frequency enabling the compactor to be effectively operated at different speeds and variations in amplitude affecting the degree of compaction made by the drums. In a typical project for forming an asphalt mat, such as in roadway constructions, the paver vehicle forms a continuous mat of material behind the paver vehicle as the paver vehicle travels forwardly upon the base surface. One or more compactor vehicles follow the paver vehicle and generally roll over all sections of the formed material mat until the formed material mat is compacted to a desired degree or extent. Preferably, the formed material mat is formed such that the material is within a desired temperature band. If sections of the formed material mat are at a lower than preferred temperature, the compactor(s) may have to make additional passes across these sections to ensure sufficient compaction. On the other hand, if sections of the formed material mat are at a higher than preferred temperature, compactor operators will have to take caution to avoid over compacting these sections.

If would therefore be desirable to provide a system to monitor the temperature of the formed material mat as the formed material mat is being formed such that the temperature information may be used by an operator of a paver vehicle or a compactor vehicle to make appropriate adjustments to the operational parameters of the paver vehicle or compaction vehicle. Further, it would be desirable to provide a system for readily identifying sections of a formed material mat that may require additional compaction or sections of a formed material mat where it may be necessary to compact with greater caution. Furthermore, it would be desirable to provide a system for using formed sensed material mat temperature information to automatically adjust paver vehicle or compactor vehicle operations to provide an acceptable formed material mat.

One example of a system for improving operation and efficiency of paving equipment is disclosed in U.S. Pat. No. 6,749,364 to Baker et al. ("Baker"). Specifically, Baker discloses a pavement temperature monitoring system used on a paver vehicle, which sends signals to a display device on the paver vehicle to generate a graphical image of a formed material mat temperature profile. Baker's approach for improving operation of paving equipment may be overly complex, and may not provide optimum flexibility for notifying compactor operators as quickly as possible of information they need to immediately adjust operational parameters of the compactor.

The present disclosure is directed to overcoming one or more of the problems set forth above and/or other problems with existing technology.

SUMMARY

One aspect of the disclosure is directed to a method for controlling a paving operation. The method may include applying asphalt to a surface using a screed mounted on a paving machine, scanning a surface of the asphalt as it is applied by the screed immediately behind the paving machine using a thermal scanner mounted on the paving machine, and transmitting a signal indicative of a scanned temperature of the asphalt from the paving machine. A compactor following the paving machine may receive the signal indicative of the scanned temperature of the asphalt, and operational parameters of the compactor may be affected as a function of the signal received at the compactor.

Another aspect of the disclosure is directed to an asphalt paving temperature alert system including a paving machine and a compactor. The paving machine may include a screed, and may be configured to apply asphalt to a sub-surface in a formed mat using the screed. A thermal scanner may be mounted on the paving machine, with the thermal scanner being configured to scan a surface of the formed mat of asphalt as it is applied by the screed. A transmitter may be mounted on the paving machine, with the transmitter being configured to transmit a signal indicative of a scanned temperature of the asphalt from the paving machine to a receiver mounted on the compactor. The receiver may be configured to receive the signal indicative of the scanned temperature of the asphalt, and an alarm on the compactor may be configured to selectively initiate a notification to a compactor operator based upon the signal received by the receiver on the compactor.

Yet another aspect of the disclosure is directed to a paving system including a paving machine and a compactor. The paving machine may include a thermal scanner mounted on the paving machine in a position suitable for scanning a surface temperature of paving material being applied by the paving machine. The paving machine may also include a controller configured to receive electrical signals from the thermal scanner, with the electrical signals being indicative of the surface temperature of the paving material being applied by the paving machine, determine whether the surface temperature of the paving material is outside of a predetermined range of temperatures, and transmit a signal to the compactor to provide an alert for a compactor operator when the surface temperature of the paving material is outside of the predetermined range of temperatures.

DETAILED DESCRIPTION

Figure 1:
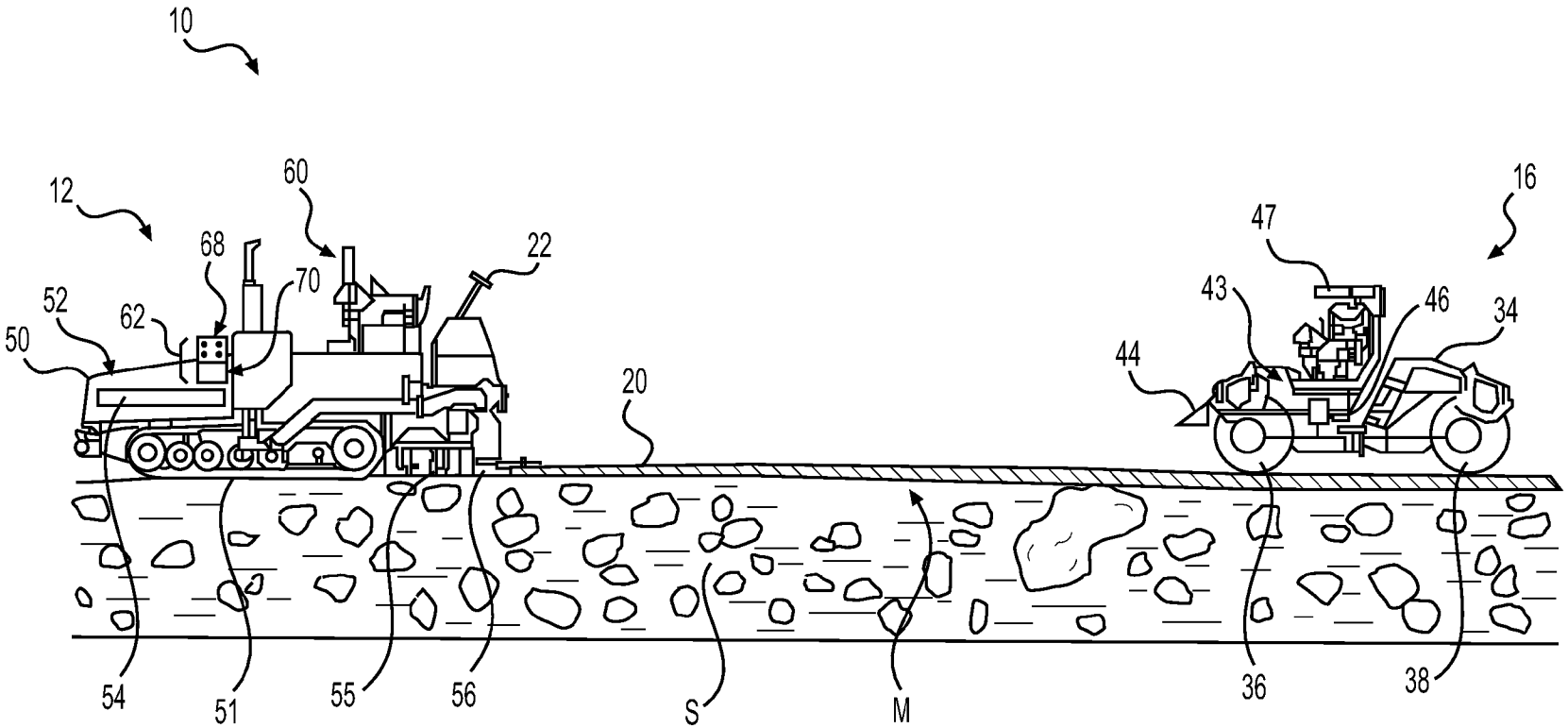
FIG. 1 shows a diagrammatic illustration of an exemplary paving system.

FIG. 1 illustrates portions of an exemplary paving system 10 according to one exemplary embodiment. Paving system 10 may include a plurality of different machines, and in the illustrated embodiment includes a paving machine 12 and a compactor 16. The various machines of paving system 10 are shown approximately as they might appear during paving of a paving material M on a sub-grade S. Paving machine 12 may travel across sub-grade S and dispense paving material M, which may be subsequently compacted by compactor 16. As further described herein, paving system 10 may be configured to control compactor 16 and, optionally, additional compactors to optimize paving smoothness, depth, and/or a compaction level of paving material M.

Paving machine 12 may generally include a frame 50 configured to support a hopper 52 for temporarily storing paving material M. In the disclosed embodiment, paving material M may be an asphalt material comprising an aggregate and a binder. It should be noted, however, that other materials may alternatively be utilized, such as soil, gravel, and other known paving materials. Paving machine 12 may further include a feeder conveyor 54 and auger(s) 55 configured to dispense paving material M from hopper 52 onto sub-grade S for conventional leveling, preliminary compacting, thickness control, etc., via a screed 56. Paving machine 12 may further include a plurality of ground-engaging elements 51, such as wheels or tracks configured to propel paving machine 12, and an operator station 60.

Hopper 52 may have an open top to receive paving material M from any known mechanism, for example, from a dump truck. Hopper 52 may also have an open bottom to allow feeder conveyor 54 and auger 55 to dispense material M out of hopper 52 and onto sub-grade S to form a material mat 20. Hopper 52 may be fixedly integrated into frame 50 of paving machine 12. The side walls of hopper 52 may be fixed or alternatively may be pivotable to allow for a maximum capacity during paving processes and a minimum width during transport.

One or more feeder conveyors 54 may be connected to the bottom of hopper 52. If multiple feeder conveyors are used, they may be placed side-by-side and run parallel to one another. Feeder conveyor 54 may transport paving material M from hopper 52 to a rear of paving machine 12, where paving material M may be dispensed behind paving machine 12 onto sub-grade S and moved across the front of screed 56 by auger 55.

Screed 56 may be attached at the rear of paving machine 12 and may be configured to level, shape, and/or position paving material M dispensed by feeder conveyor 54 and auger 55. Typically, paving material M may be dispensed via paving machine 12 at an irregular thickness according to the surface profile of sub-grade S. The surface profile of the dispensed paving material M may vary inversely with the profile of sub-grade S. For example, relatively thinner sections of paving material M may be dispensed over elevated portions of sub-grade S and relatively thicker sections of paving material M may be dispensed over depressions in sub-grade S. The height of screed 56 may be altered in response to these variations according to mechanisms known in the art.

Paving machine 12 may also include a thermal scanner 22 mounted at the rear of frame 50, and configured to sense the surface temperature of a formed material mat 20 being applied to sub-grade S by screed 56. A controller 62 may be mounted on frame 50, in operator compartment 60, or in certain alternative implementations, may be external to paving machine 12. Controller 62 may be configured to receive an electrical signal from thermal scanner 22, with the electrical signal being indicative of the sensed surface temperature of material mat 20. In certain implementations the electrical signal provided by thermal scanner 22 may be processed by a thermal scan processor 68, which may be part of or separate from controller 62. Processing by the thermal scan processor 68 may include converting a plurality of parallel input signals from a thermal detector array in thermal scanner 22 into a serial output signal. The thermal scan processor may include a converter circuit for converting the parallel input signals into a plurality of current signals. An integration circuit may also be provided with thermal scan processor 68 for integrating the current signals for a predetermined length of time. The integration circuit may be operable to generate a plurality of voltages in response to the current signals. A storage circuit may also be provided to generate and store a plurality of storage signals that are proportional to the plurality of voltages generated by the integration circuit. A multiplexing circuit may also be provided to generate the serial output signal from the storage signals generated by the storage circuit.

Thermal scanner 22 may be any appropriate type of thermal measuring or sensing device/system and preferably is capable of "remotely" sensing the temperature of formed material mat 20 without the need for any portion of thermal scanner 22 to make physical contact with mat 20. However, in certain alternative implementations, an appropriate "contact" type of temperature sensor, such as, for example, a thermocouple with a sensing junction (not shown) may be used. With such a "contact" type of temperature sensor, caution must be taken to ensure that the contact type of temperature sensor does not scratch or otherwise damage mat 20 or become itself damaged by contact with mat 20. Most preferably, thermal scanner 22 is either a thermal imager, a thermal scanner, or a thermal imager operating in "line-scan" mode. Thermal scanner 22 may be mounted at a rear end of paving machine 12 at a height sufficiently above mat 20 so as to be capable of viewing, and thus imaging, or scanning across substantially the entire width of mat 20.

Thermal scanner 22 may include one or more temperature detectors and/or sensors, such as, for example, a video camera with an infrared filter, with the temperature detector and/or sensor receiving heat or infrared energy from the top surface of mat 20, and generating electrical signals corresponding to the thermal image of the surface. Thermal scanner 22 may include one or more temperature detectors and/or sensors, as well as optical elements (e.g., one or more mirrors) to present the one or more temperature detectors and/or sensors with infrared energy from a plurality of locations on mat 20 to construct a thermal image of the top surface of the mat. Thermal scanner 22 may be configured to generate a plurality of electrical signals corresponding to the sensed mat temperature at a plurality of locations on mat 20. The electrical signals generated by the thermal scanner, which are representative of the sensed mat temperature at each of the plurality of locations on mat 20, may be aggregated, processed by thermal scan processor 68, and transmitted by appropriate means (e.g., wireless, cellular, wi-fi, etc.) to a display device mounted on compactor 16. In alternative implementations, the electrical signals generated by thermal scanner 22 may be processed by thermal scan processor 68 and transmitted to the compactor as an alert to notify a compactor operator that the temperature of at least a portion of mat 20 is outside of a preferred range. Preferably, the thermal scanner is capable of repeatedly scanning across at least a portion of the width of mat 20 so as to periodically sense the mat temperature at successive sections of mat 20 along or with respect to the direction of travel of paving machine 12. Thus, each side-to-side pass of the thermal scanner across the width of mat 20 provides temperature measurements for a strip-like section of mat 20 and the series of repeated passes and scans provide temperature information on each successive strip of mat 20 as paving machine 12 continues to travel and apply the mat 20.

Compactor 16 may include one or more audio, video, or audio and video devices that are capable of receiving processed electrical signals from the paving machine 12, or from one or more controllers external to paving machine 12 that receive the processed electrical signals from paving machine 12. A display device may also be provided on compactor 16 in view of a compactor operator. The display device may be capable of receiving the plurality of electrical signals from the thermal scanner 22 and generating and displaying an alert to the compactor operator. In some implementations, a graphical image may be generated by the display device that is representative of the sensed mat temperature profile of a section of the mat 20 corresponding to the plurality of electrical signals received from the thermal scanner 22. In addition, compactor 16 may include any of a number of different audio, video, or audio/video alarms that warn an operator of the compactor when the temperature of material mat 20 has moved outside of a preferred range, has exceeded a predetermined maximum temperature, or is less than a predetermined minimum temperature. The display device on compactor 16 is preferably capable of periodically updating graphical images that are representative of the formed mat temperature at successive sections on mat 20 as paving machine 12 continues to travel.

Compactor 16 may include a frame 34, having at least a front compacting drum 36. In the disclosed embodiment, compactor 16 also includes a rear compacting drum 38 coupled to frame 34. Compactor 16 may further include a controller 43, including a receiver 44 configured to communicate with a transmitter 70. It should be noted, however, that controller 43 may not be integral with compactor 16, if desired. Controller 43 may further include an electronic control unit 46. Controller 43 may also be operatively connected to a GPS device 47. Receiver 44 may be configured to receive signals indicative of the temperature of mat 20, as well as signals indicative of the geographical position on mat 20 at which the temperatures were measured, and the geographical position of compactor 16.

Figure 2:
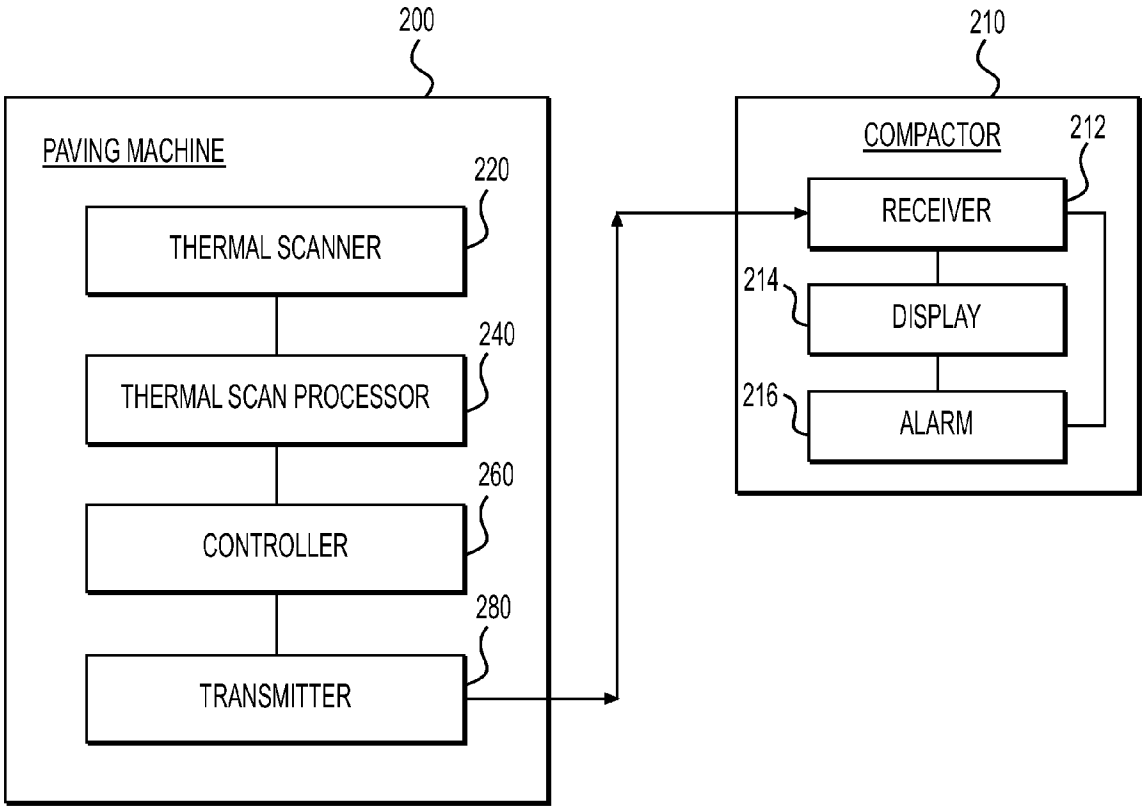
FIG. 2 is a block diagram of an exemplary control configuration for the paving system of FIG. 1.

In an exemplary implementation illustrated in FIG. 2, a paving machine 200 may include a thermal scanner 220 mounted on paving machine 200 in an orientation that provides a clear line of sight to freshly applied asphalt material being laid down in a mat immediately behind the paving machine. The paving machine 200 may include a thermal scan processor 240 that is configured to receive and process electrical signals from thermal scanner 220, a controller 260 configured to determine whether the temperature of the formed material mat of asphalt material is within a preferred range of temperatures, and a transmitter 280 configured to send a signal to a compactor 210 following behind the paving machine 200. Compactor 210 may include a receiver 212 configured to receive the signal transmitted by controller 260 and transmitter 280 on paving machine 200. In various alternative implementations, controller 260 may be located partially or completely remote from paving machine 200. For example, controller 260 may be physically located at a mobile command center in the vicinity of the work site where the paving machine is operating, or at a central command site communicating with paving machine 200 via satellite, over wireless networks, cellular networks, wi-fi networks, or other communication networks. A display 214 on compactor 210 may generate and display a graphical image representative of the sensed formed material mat temperature profile of a section of formed material mat 20 (shown in FIG. 1) corresponding to the plurality of electrical signals produced by thermal scanner 220 on paving machine 200. The graphical image may be periodically updated with sensed mat temperature information from each successive pass of thermal scanner 220 across mat 20 such that the graphical image scrolls on display 214 as paving machine 200 travels and mat 20 is being formed. In some exemplary implementations of paving system 10, a thermal scanner such as the thermal scanner sold under the trademark MOBA PAVE-IR™ may be used.

In some exemplary implementations, display 214 on compactor 210 may be either a cathode ray tube (CRT) type display device or a liquid crystal display (LCD) display device. The graphical image presented on display 214 may allow an operator of compactor 210 to see a "real-time" thermal profile of the formed material mat 20. An appropriate software program or some combination of hardware, software, and/or firmware contained within one or more of the receiver 212 and display 214 of compactor 210 may generate such a "real-time" graphical image.

In various alternative implementations, display 214 may comprise a liquid crystal display (LCD) type display device. The electrical signal output of thermal scanner 220 may be passed through thermal scan processor 240, which may include an analog/digital (A/D) converter, so that digital signals representative of the scanned mat temperature may be sent to the liquid crystal display (LCD) type display device. A portion of the output from thermal scanner 220 may be transmitted to controller 260, in some implementations only after being processed by thermal scan processor 240. Controller 260 may be provided with programmable memory for storing mat temperature data after the raw temperature data has been processed by thermal scan processor 240. A graphical image may be displayed on display 214 on compactor 210 to provide a visual representation of thermal gradients existing across formed material mat 20. Significant thermal gradients may affect the quality of the formed material mat 20. In particular, colder spots of formed material mat 20 may be more difficult to compact than hotter spots and, if not compacted correctly, may cause premature damage to occur to formed material mat 20. As a result, the temperature information provided from the thermal scanner on paving machine 200 to compactor 210 may be used by a compactor operator to control and improve the quality of paving operations.

Various graphical images may be generated by thermal scan processor 240 and controller 260 on paving machine 200, and then transmitted by transmitter 280 to receiver 212 on compactor 210. The images may then be displayed on display 214 of compactor 210, and various different types of warnings or alarms may be generated by alarm 216. The graphical images provided on display 214 of compactor 210 may depict various manners of representing the thermal profile of a typical freshly-laid formed material mat 20. The particular display information may include actual temperature profiles taken along different lines extending across mat 20. The mat temperature data may additionally, or alternatively, be presented in the form of data tables and may include maximum, minimum, and average temperatures along the lines extending across mat 20, within a particular area of mat 20, or at a particular point on mat 20. The display 214 used in a particular application may include less or additional sensed mat temperature data, and/or present the sensed mat temperature data in different formats (e.g., a liquid crystal display (LCD) type display with a numerical read-out of the sensed formed material mat temperature).

In some implementations, controller 260 on paving machine 200 may be configured such that temperature data received from thermal scanner 220 is only recorded and/or processed for transmitting to compactor 210 and displaying on display 214 when paving machine 200 is in motion. Similarly, controller 260 on paving machine 200 may be configured to only send signals that may result in an alarm being initiated by alarm 216 on compactor 210 when the paving machine is moving. In addition, the forward speed of paving machine 200 may be simultaneously recorded and processed to allow the position of paving machine 200 relative to sub-grade S to be determined and the mat thermal profiles cross-referenced or correlated to specific locations on the road or on mat 20. In various alternative implementations, at least one of a motion sensor, a speed sensor, and a position sensor, may be disposed on paving machine 12. The thermal scanner 220 may be configured to pause scanning when the paving machine 12 is idle or has stopped moving so that the thermal scanner scans only when the paving machine 12 is moving to avoid re-scanning areas of mat 20 that have already been displayed on display 214. A position sensor may be configured to sense the position of the paving machine 12 with respect to the sub-surface S, and thus provide an indication of the locations on mat 20 that are being viewed or scanned by thermal scanner 220. The position sensor may be any appropriate position sensing device, such as for example, a global positioning system (G.P.S.) system or a laser-based position sensing system.

The controller 260 may include a resident software program capable of correlating the sensed paving machine positions with the sensed mat temperatures to provide information as to the sensed mat temperature at each position on mat 20 that is scanned or viewed. Further, controller 260 may include a database software program or may be connected to a separate database system. As mentioned above, controller 260 may also be located remote from the paving vehicle 12, such as at a mobile command center or a central command site. The database software program or system may be capable of storing the correlated sensed paving vehicle position information and the sensed mat temperature information so the correlated information may be stored, and later analyzed and/or reproduced, for the entire length of mat 20 paved by the paving machine 12. This correlated sensed paver vehicle position information and the sensed formed material mat temperature information may also be used for monitoring wear of formed material mat 20 and to provide quality assurance information.

Exemplary methods of controlling operation of compactor 210 are discussed in the following section in order to further illustrate the concepts discussed above.

INDUSTRIAL APPLICABILITY

The disclosed exemplary system and methods provide information on the real-time temperature at the surface of newly laid asphalt material applied in a mat by the screed of a paving machine. A thermal scanner mounted on the paving machine senses the temperatures across the surface of the mat immediately after it is applied. This temperature data may be processed by a thermal scan processor and controller also mounted on the paving machine, or may be further processed by a controller located remote from the paving machine. The processing of the temperature data sensed by the thermal scanner on the paving machine provides accurate real-time information that can be transmitted to a compactor operator on a compactor following the paving machine. The processed temperature data may result in the controller transmitting a signal to the compactor, with the signal resulting in the initiation of an alarm or other event that notifies the compactor operator that the asphalt material is no longer within a preferred range of temperatures for optimum compaction. Additionally, or in the alternative, the temperature data sensed by the thermal scanner on the paving machine may be processed in order to provide signals that may be transmitted to a display on the compactor, resulting in a graphical depiction of a real-time temperature profile across the surface of a newly applied mat of asphalt.

Using the sensed mat temperature information from the display on the compactor, or in response to an alarm or other event initiated at the compactor as a result of processed data received from the paving machine, the operator of the compactor may adjust, if necessary, one or more operational parameters of compactor. These operational parameters may include the frequency of a compaction vibrator on the compactor, and/or the travel speed of the compactor 210. Manual adjustment of these operational parameters may help the compactor operator achieve acceptable compaction levels and smoothness of the formed material mat of asphalt. The display 214 of compactor 210 may include a screen that provides the operator of the compactor with a graphical image of the mat temperature at particular locations or sections on the formed material mat 20. Alternatively, the display may only indicate the mat temperature levels in reference to a "target" or desired temperature value or range. For example, controller 260 on paving machine 200 may compare the sensed mat temperature with a "target" or desired temperature value or range, and then generate an appropriate control signal that is sent to compactor 210. An audible alarm, visual alarm, combination of audible and visual alarms, or other events may be initiated by alarm 216 on compactor 210 to indicate when the sensed mat temperature is below a first selected temperature value or above a second selected temperature value to indicate to the operator of compactor 210 that adjustments to the operating parameters of compactor 210 may be in order.

In various alternative implementations, the temperature data transmitted by transmitter 280 on paving machine 200 to compactor 210 may be used to automatically control operational parameters of compactor 210 using an automatic control system or controller. An automatic control system or controller, such as represented by controller 43 in FIG. 1, may be connected with and capable of adjusting the operation of appropriate components of compactor 210, such as, for example, a vibration mechanism (not shown). If the sensed formed material mat temperature is lower than a "target" or desired temperature value, the operator of compactor 210, or an automatic control system or controller 43 may reduce the travel speed of compactor 210 and/or increase the vibration frequency and/or amplitude. On the other hand, if the sensed formed material mat temperature is higher than a "target" or desired temperature value, the operator, or an automatic control system or controller 43 may increase the travel speed of compactor 210 and/or decreases the vibration frequency and/or amplitude.

It will be apparent to those skilled in the art that various modifications and variations can be made to the disclosed temperature alert system for a compactor operator without departing from the scope of the disclosure. Other embodiments of the temperature alert system will be apparent to those skilled in the art from consideration of the specification and practice of the methods disclosed herein. It is intended that the specification and examples be considered as exemplary only, with a true scope of the disclosure being indicated by the following claims and their equivalents.

What is claimed is:

1. A method for controlling a paving operation, the method comprising:

applying asphalt to a surface using a screed mounted on a paving machine;

scanning a surface of the asphalt as it is applied by the screed immediately behind the paving machine using a thermal scanner mounted on the paving machine;

transmitting a signal indicative of a scanned temperature of the asphalt from the paving machine;

receiving the signal indicative of the scanned temperature of the asphalt at a compactor following the paving machine, the compactor being distinct from the paving machine; and affecting operational parameters of the compactor as a function of the signal received at the compactor, including initiating an alarm on a display mounted to the compactor in response to the signal received at the compactor to notify a compactor operator that a temperature of the asphalt immediately behind the paving machine is no longer within a preferred range of temperatures.

2. The method of claim 1, wherein the affecting operational parameters of the compactor further includes automatically controlling operational parameters of the compactor using an automatic control system.

3. The method of claim 2, wherein the automatically controlling operational parameters of the compactor includes controlling at least one of a frequency and an amplitude of vibration of a compacting drum of the compactor.

4. The method of claim 1, wherein the initiating the alarm includes one or more of initiating an audible alarm, initiating a visual alarm, and initiating a combined audible and visual alarm.

5. The method of claim 1, further comprising processing with a thermal scan processor a plurality of input signals received from a thermal detector array included in the thermal scanner, and converting the plurality of input signals into a serial output signal.

6. The method of claim 1, wherein the thermal scanner mounted on the paving machine remotely senses temperatures across the surface of the asphalt without any portion of the thermal scanner making physical contact with the asphalt.

7. The method of claim 6, wherein the thermal scanner mounted on the paving machine is a thermal imager operating in a line scan mode and configured to pause scanning when the paving machine is idle or has stopped moving.

8. The method of claim 1, further comprising:

sensing a temperature profile across a section of the applied asphalt using the thermal scanner and generating electrical signals representative of the sensed temperature profile; and receiving the electrical signals at a thermal scan processor, processing the electrical signals, and sending the processed electrical signals to a controller.

9. The method of claim 8, wherein the controller is mounted on the paving machine.

10. The method of claim 8, wherein the controller is located off of the paving machine at a mobile command center located in the vicinity of a work site where the paving machine is operating.

11. The method of claim 8, wherein the controller is located off of the paving machine at a central command site communicating with the paving machine over a communication network.

12. The method of claim 1, further comprising repeatedly scanning across at least a portion of the surface of the asphalt as it is applied by the screed in order to periodically sense the temperature at successive sections of the asphalt in a direction of travel of the paving machine.

13. The method of claim 12, wherein the repeated scanning across at least a portion of the surface of the asphalt provides temperature measurements for a plurality of strip-wise sections of the asphalt, successive strips of the plurality of strip-wise sections extending sequentially along a direction of travel of the paving machine.

14. An asphalt paving temperature alert system, comprising:

a paving machine including a screed and being configured to apply asphalt to a sub-surface in a formed mat using the screed;

a compactor that is distinct from the paving machine;

a thermal scanner mounted on the paving machine, the thermal scanner being configured to scan a surface of the formed mat of asphalt as it is applied by the screed;

a transmitter mounted on the paving machine;

a first controller operatively coupled to the thermal scanner and the transmitter, the first controller being configured to transmit a signal indicative of a scanned temperature of the asphalt from the paving machine;

a receiver mounted on the compactor;

a display mounted on the compactor;

a second controller operatively coupled to the receiver and the display, the second controller being configured to receive the signal indicative of the scanned temperature of the asphalt via the receiver, and activate an alarm on the compactor display in response to the signal received from the paving machine, the alarm being configured to notify a compactor operator that a temperature of the asphalt immediately behind the paving machine is no longer within a preferred range of temperatures.

15. The asphalt paving temperature alert system of claim 14, further comprising a thermal scan processor configured to process electrical signals produced by the thermal scanner, wherein the signal indicative of the scanned temperature of the asphalt from the paving machine is an alert signal configured to activate the alarm to the compactor operator that the temperature of the asphalt is outside the preferred range of temperatures.

16. The asphalt paving temperature alert system of claim 14, wherein the second controller is further configured to automatically control operational parameters of the compactor as a function of the signal indicative of the scanned temperature of the asphalt.

17. The asphalt paving temperature alert system of claim 16, wherein the second controller is further configured to automatically control operational parameters of the compactor by controlling at least one of a frequency and an amplitude of vibration of a compacting drum of the compactor.

18. A paving system, comprising:

a paving machine; and a compactor that is distinct from the paving machine, the paving machine including:

a thermal scanner, the thermal scanner being mounted on the paving machine in a position suitable for scanning a surface temperature of paving material being applied by the paving machine; and a first controller operatively coupled to the thermal scanner, the first controller being configured to receive electrical signals from the thermal scanner, the electrical signals being indicative of the surface temperature of the paving material being applied by the paving machine, determine whether the surface temperature of the paving material is outside of a predetermined range of temperatures, and transmit a signal to the compactor when the surface temperature of the paving material is outside the predetermined range of temperatures, the compactor including:

a receiver;

a display; and a second controller operatively coupled to the receiver and the display, the second controller being configured to receive the signal from the paving machine via the receiver, and activate an alarm on the display in response to the signal received from the paving machine to notify an operator of the compactor that the surface temperature of the paving material immediately behind the paving machine is outside the predetermined range of temperatures.

19. The paving system of claim 18, wherein the first controller is further configured to process the electrical signals received from the thermal scanner and thereby generate signals that may be transmitted to the display on the compactor to generate a graphical depiction of a real-time temperature profile across the surface of the applied paving material.

* * * * *